US008970637B2

(12) United States Patent
Moon et al.

(10) Patent No.: US 8,970,637 B2
(45) Date of Patent: Mar. 3, 2015

(54) UNIT AND METHOD OF CONTROLLING FRAME RATE AND LIQUID CRYSTAL DISPLAY DEVICE USING THE SAME

(75) Inventors: Sung Joon Moon, Paju-si (KR); Sang Hoon Lee, Daegu (KR); Kyu Ha Oh, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 1191 days.

(21) Appl. No.: 12/591,358

(22) Filed: Nov. 17, 2009

(65) Prior Publication Data

US 2010/0134533 A1 Jun. 3, 2010

(30) Foreign Application Priority Data

Dec. 1, 2008 (KR) ..... 10-2008-0120251

(51) Int. Cl.
*G09G 5/10* (2006.01)
*G09G 3/36* (2006.01)
*G09G 3/20* (2006.01)

(52) U.S. Cl.
CPC ..... *G09G 3/3611* (2013.01); *G09G 3/2055* (2013.01); *G09G 2340/0435* (2013.01); *G09G 2360/16* (2013.01)
USPC ..... 345/690

(58) Field of Classification Search
USPC ..... 345/87–104, 204, 690, 694, 696
See application file for complete search history.

(56) References Cited

U.S. PATENT DOCUMENTS

| | | | | |
|---|---|---|---|---|
| 5,583,530 | A * | 12/1996 | Mano et al. | 345/89 |
| 2003/0193464 | A1* | 10/2003 | Yamano et al. | 345/89 |
| 2004/0257325 | A1* | 12/2004 | Inoue | 345/89 |
| 2008/0180380 | A1 | 7/2008 | Jung | |
| 2009/0122054 | A1* | 5/2009 | Lee et al. | 345/214 |

FOREIGN PATENT DOCUMENTS

| | | | |
|---|---|---|---|
| CN | 200947341 | Y | 9/2007 |
| KR | 10-2002-0093815 | A | 12/2002 |
| KR | 10-2008-0037756 | A | 5/2008 |
| KR | 10-2008-0070907 | A | 8/2008 |

* cited by examiner

*Primary Examiner* — Kathy Wang-Hurst
*Assistant Examiner* — Joseph Fox
(74) *Attorney, Agent, or Firm* — McKenna Long & Aldridge LLP

(57) ABSTRACT

A frame rate control method capable of enhancing picture-quality is disclosed. The frame rate control method generates red, green, and blue frame rate control signals by frame-rate-modulating red, green, and blue frame rate control patterns on the basis of lower-bit red, green, and blue data. The lower-bit red, green, and blue data are extracted from red, green, and blue data. The red, green and blue frame rate control patterns are obtained through a process of shifting basic frame rate control patterns by different sub-pixel numbers in one direction. The basic frame rate control patterns are established for a plurality of frames.

17 Claims, 11 Drawing Sheets

FIG. 1B (Related Art)

FIRST FRAME

| R | G | B | R | G | B | R | G | B | R | G | B | R | G | B | R | G | B | R | G | B | R | G | B |
|---|---|---|---|---|---|---|---|---|---|---|---|---|---|---|---|---|---|---|---|---|---|---|---|
| + | + | − | − | + | + | − | − | + | + | − | − | + | + | − | − | + | + | − | − | + | + | − | − |
| − | − | + | + | − | − | + | + | − | − | + | + | − | − | + | + | − | − | + | + | − | − | + | + |
| + | + | − | − | + | + | − | − | + | + | − | − | + | + | − | − | + | + | − | − | + | + | − | − |
| − | − | + | + | − | − | + | + | − | − | + | + | − | − | + | + | − | − | + | + | − | − | + | + |

SECOND FRAME

| R | G | B | R | G | B | R | G | B | R | G | B | R | G | B | R | G | B | R | G | B | R | G | B |
|---|---|---|---|---|---|---|---|---|---|---|---|---|---|---|---|---|---|---|---|---|---|---|---|
| − | − | + | + | − | − | + | + | − | − | + | + | − | − | + | + | − | − | + | + | − | − | + | + |
| + | + | − | − | + | + | − | − | + | + | − | − | + | + | − | − | + | + | − | − | + | + | − | − |
| − | − | + | + | − | − | + | + | − | − | + | + | − | − | + | + | − | − | + | + | − | − | + | + |
| + | + | − | − | + | + | − | − | + | + | − | − | + | + | − | − | + | + | − | − | + | + | − | − |

THIRD FRAME

| R | G | B | R | G | B | R | G | B | R | G | B | R | G | B | R | G | B | R | G | B | R | G | B |
|---|---|---|---|---|---|---|---|---|---|---|---|---|---|---|---|---|---|---|---|---|---|---|---|
| + | + | − | − | + | + | − | − | + | + | − | − | + | + | − | − | + | + | − | − | + | + | − | − |
| − | − | + | + | − | − | + | + | − | − | + | + | − | − | + | + | − | − | + | + | − | − | + | + |
| + | + | − | − | + | + | − | − | + | + | − | − | + | + | − | − | + | + | − | − | + | + | − | − |
| − | − | + | + | − | − | + | + | − | − | + | + | − | − | + | + | − | − | + | + | − | − | + | + |

FOURTH FRAME

| R | G | B | R | G | B | R | G | B | R | G | B | R | G | B | R | G | B | R | G | B | R | G | B |
|---|---|---|---|---|---|---|---|---|---|---|---|---|---|---|---|---|---|---|---|---|---|---|---|
| − | − | + | + | − | − | + | + | − | − | + | + | − | − | + | + | − | − | + | + | − | − | + | + |
| + | + | − | − | + | + | − | − | + | + | − | − | + | + | − | − | + | + | − | − | + | + | − | − |
| − | − | + | + | − | − | + | + | − | − | + | + | − | − | + | + | − | − | + | + | − | − | + | + |
| + | + | − | − | + | + | − | − | + | + | − | − | + | + | − | − | + | + | − | − | + | + | − | − |

GREEN FRC PATTERN ("+1")

FIG. 6A

FIRST FRAME

| R | R | R | R | R | R | R | R |
|---|---|---|---|---|---|---|---|
| + | − | − | + | + | − | − | + |
| − | + | + | − | − | + | + | − |
| + | − | − | + | + | − | − | + |
| − | + | + | − | − | + | + | − |

SECOND FRAME

| R | R | R | R | R | R | R | R |
|---|---|---|---|---|---|---|---|
| − | + | + | − | − | + | + | − |
| + | − | − | + | + | − | − | + |
| − | + | + | − | − | + | + | − |
| + | − | − | + | + | − | − | + |

THIRD FRAME

| R | R | R | R | R | R | R | R |
|---|---|---|---|---|---|---|---|
| + | − | − | + | + | − | − | + |
| − | + | + | − | − | + | + | − |
| + | − | − | + | + | − | − | + |
| − | + | + | − | − | + | + | − |

FOURTH FRAME

| R | R | R | R | R | R | R | R |
|---|---|---|---|---|---|---|---|
| − | + | + | − | − | + | + | − |
| + | − | − | + | + | − | − | + |
| − | + | + | − | − | + | + | − |
| + | − | − | + | + | − | − | + |

FIG. 6B

FIRST FRAME

| G | G | G | G | G | G | G | G |
|---|---|---|---|---|---|---|---|
| + | + | − | − | + | + | − | − |
| − | − | + | + | − | − | + | + |
| + | + | − | − | + | + | − | − |
| − | − | + | + | − | − | + | + |

SECOND FRAME

| G | G | G | G | G | G | G | G |
|---|---|---|---|---|---|---|---|
| − | − | + | + | − | − | + | + |
| + | + | − | − | + | + | − | − |
| − | − | + | + | − | − | + | + |
| + | + | − | − | + | + | − | − |

THIRD FRAME

| G | G | G | G | G | G | G | G |
|---|---|---|---|---|---|---|---|
| + | + | − | − | + | + | − | − |
| − | − | + | + | − | − | + | + |
| + | + | − | − | + | + | − | − |
| − | − | + | + | − | − | + | + |

FOURTH FRAME

| G | G | G | G | G | G | G | G |
|---|---|---|---|---|---|---|---|
| − | − | + | + | − | − | + | + |
| + | + | − | − | + | + | − | − |
| − | − | + | + | − | − | + | + |
| + | + | − | − | + | + | − | − |

FIG. 6C

FIRST FRAME

| B | B | B | B | B | B | B | B |
|---|---|---|---|---|---|---|---|
| − | + | + | − | − | + | + | − |
| + | − | − | + | + | − | − | + |
| − | + | + | − | − | + | + | − |
| + | − | − | + | + | − | − | + |

SECOND FRAME

| B | B | B | B | B | B | B | B |
|---|---|---|---|---|---|---|---|
| + | − | − | + | + | − | − | + |
| − | + | + | − | − | + | + | − |
| + | − | − | + | + | − | − | + |
| − | + | + | − | − | + | + | − |

THIRD FRAME

| B | B | B | B | B | B | B | B |
|---|---|---|---|---|---|---|---|
| − | + | + | − | − | + | + | − |
| + | − | − | + | + | − | − | + |
| − | + | + | − | − | + | + | − |
| + | − | − | + | + | − | − | + |

FOURTH FRAME

| B | B | B | B | B | B | B | B |
|---|---|---|---|---|---|---|---|
| + | − | − | + | + | − | − | + |
| − | + | + | − | − | + | + | − |
| + | − | − | + | + | − | − | + |
| − | + | + | − | − | + | + | − |

UNIT AND METHOD OF CONTROLLING FRAME RATE AND LIQUID CRYSTAL DISPLAY DEVICE USING THE SAME

CROSS-REFERENCE TO RELATED APPLICATION

This application claims priority under 35 U.S.C. 119 to Korean Patent Application No. 10-2008-0120251, filed on Dec. 1, 2008, which is hereby incorporated by reference as if fully set forth herein.

BACKGROUND

1. Field of the Disclosure

This disclosure relates to frame rate control unit and method adapted to enhance picture-quality, and a liquid crystal display device with the same.

2. Description of the Related Art

As the information society grows, display devices capable of displaying information have been widely developed. These display devices include liquid crystal display (LCD) devices, organic electro-luminescence display (OLED) devices, plasma display devices, and field emission display devices.

Among the above display devices, LCD devices have the advantage in that they are light, small, and can provide a low power drive and a full color scheme. Accordingly, LCD devices have become widely used for mobile phones, navigation systems, portable computers, televisions and so on.

The LCD device includes a timing controller transferring red, green, and blue (RGB) data from external video source to a data driver. The RGB data is converted in an analog data voltage and applied to a liquid crystal panel. The LCD device further includes a gate driver configured to drive gate lines on the liquid crystal panel.

In general, the RGB data applied to the timing controller consists of 8 data bits. As such, the data driver is configured to process the 8 bits of RGB data. However, the data driver capable of processing the 8 bits of RGB data is at a very high price. In view of this point, a data driving method capable of allowing the 8 bits of RGB data to be processed by a data driver with less than 8 bits is keenly required.

To meet this requirement, a frame rate control (FRC) method has been proposed which realizes the gray levels of at least one lower data bit among 8-bit RGB data by at least two continuous frames. The FRC method derives fewer bits of RGB data (for example, a 6-bit or 5-bit RGB data) than 8 bits from 8-bit RGB data. To this end, the FRC method reconfigures a first fixed number of higher data bits (for example, higher 6 or 5 data bits) among 8-bit RGB data in one set of several continuous frames on the basis of a second fixed number of lower data bits (for example, lower 2 or 3 data bits). The re-configured fewer-bit RGB data can be processed by a fewer-bit data driver than 8 bits.

Meanwhile, inversion systems have been proposed, in order to prevent the deterioration of liquid crystal. The inversion systems include a dot inversion, a line inversion, and a frame inversion. The dot inversion system can include a vertical 2-dot inversion and a horizontal 2-dot inversion.

FIGS. 1A and 1B are data sheets illustrating a FRC system using a horizontal 2-dot inversion. FIG. 1A is a data sheet showing a set of FRC patterns, and FIG. 1B is a data sheet showing one set of data frames obtained by applying a horizontal 2-dot inversion to the FRC patterns.

As shown in FIG. 1A, The FRC method can provide a set of FRC patterns every 4 frames. In this case, the FRC patterns can be obtained by applying a lower 2-bit data extracted from an 8-bit RGB data to one set of 4 continuous frames.

The four FRC patterns corresponding to the 4 continuous frames can be re-formatted in a horizontal 2-dot inversion, as shown in FIG. 1B. The horizontal 2-dot inversion system inverts the polarity of RGB data every two sub-pixels in the horizontal direction. If positive polarity sub-pixel data is applied to two sub-pixels in the horizontal direction, the following two sub-pixels in the horizontal direction is designated to receive negative polarity sub-pixel data. In this manner, the polarity of the sub-pixel data can be repeatedly inverted every two sub-pixels in the horizontal direction.

The four FRC patterns, to which lower 2-bit data extracted from 8-bit RGB data is applied and the horizontal 2-dot inversion is performed, allow the number of red sub-pixels receiving positive polarity data to be the same as that of the red sub-pixels receiving negative polarity data. They also allow the number of blue sub-pixels receiving positive polarity data to be the same as that of blue sub-pixels receiving negative polarity data, in every frame. For example, among the red sub-pixels marked by diagonal lines in a first frame of FIG. 1B, the number of red sub-pixels receiving the positive polarity data is equal to that of red sub-pixels receiving the negative polarity data, as 4.

However, the number of green sub-pixels receiving the positive polarity data among the green sub-pixels is larger than that of green sub-pixels receiving the negative polarity data. For example, among the green sub-pixels marked by diagonal lines in a first frame of FIG. 1B, the number of green sub-pixels receiving the positive polarity data is "8", but the number of red sub-pixels receiving the negative polarity data is "0". On the other hand, this polarity arrangement is the same as those in a second to a fourth frames. As all of the green sub-pixels respond to the positive polarity data, defects such as flickering, noise, dimness, and others are generated in the picture displayed by the LCD device. The picture quality of the LCD device is deteriorated.

BRIEF SUMMARY

Accordingly, the present embodiments are directed to an LCD device that substantially obviates one or more of problems due to the limitations and disadvantages of the related art.

An object of the present embodiment is to provide frame rate control unit and method that are adapted to enhance picture-quality by shifting a basic FRC pattern by one sub-pixel in the horizontal direction and then performing a green frame rate control, and a liquid crystal display device with the same.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to one general aspect of the present embodiment, an FRC unit includes: a frame rate control pattern generator configured to generate red, green, and blue frame rate control patterns from basic frame rate control patterns which are established for a plurality of continuous frames; a data bit extractor configured to extract higher-bit red, green, and blue data and lower-bit red, green, and blue data from each of red, green, and blue data; and a frame rate modulator configured to generate red, green, and blue frame rate control signals by frame-rate-modulating the red, green, and blue frame rate control patterns on the basis of the respective lower-bit red, green, and blue data, wherein the green and blue frame rate control patterns are obtained through a process of shifting the basic frame rate control patterns by different sub-pixel numbers in one direction.

An FRC method according to another aspect of the present embodiment includes: deriving red, green, and blue frame rate control patterns from basic frame rate control patterns which are established for a plurality of continuous frames; extracting higher-bit red, green, and blue data and lower-bit red, green, and blue data from each of red, green, and blue data; and generating red, green, and blue frame rate control signals by frame-rate-modulating the red, green, and blue frame rate control patterns on the basis of the respective lower-bit red, green, and blue data, wherein the green and blue frame rate control patterns are obtained through a process of shifting the basic frame rate control patterns by different sub-pixel numbers in one direction.

An LCD device according to still another aspect of the present embodiment includes: a liquid crystal panel on which pixels configured to include red, green, and blue sub-pixels are arranged in a matrix; a timing controller configured to generate gate and data control signals and a horizontal 2-dot control signal used for inverting the liquid crystal panel in a horizontal 2-dot inversion system, and providing red, green, and blue frame rate control signals by generating red, green, and blue frame rate control patterns from basic frame rate control patterns which are established for a plurality of continuous frames, extracting higher-bit red, green, and blue data and lower-bit red, green, and blue data from each of red, green, and blue data, and frame-rate-modulating the red, green, and blue frame rate control patterns on the basis of the respective lower-bit red, green, and blue data; a gate driver configured to respond to the gate control signal and drive the liquid crystal panel; and a data driver configured to convert the higher-bit red, green, and blue data into analog red, green, and blue data voltages and drive the liquid crystal panel using the converted red, green, and blue data voltage according to the red, green, and blue frame rate control signals during the plurality of frames, wherein the green and blue frame rate control patterns are obtained through a process of shifting the basic frame rate control patterns by different sub-pixel numbers in one direction.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings:

FIGS. 1A and 1B are data sheets illustrating a FRC system using a horizontal 2-dot inversion;

FIG. 6A to 6C are data sheets illustrating RGB data voltages applied to sub-pixels on the basis of an FRC and a horizontal 2-dot inversion according to an embodiment of the present disclosure, respectively.

DETAILED DESCRIPTION

Figure 1A:
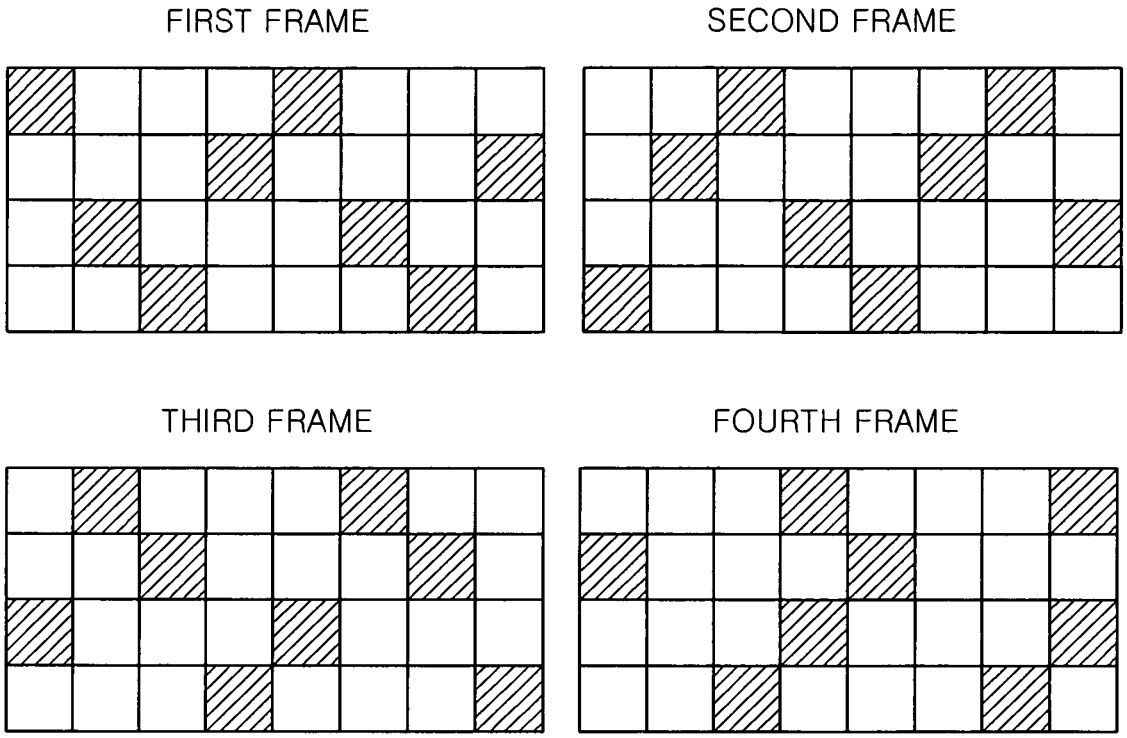
FIG. 1A (Related Art)

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

Figure 2:
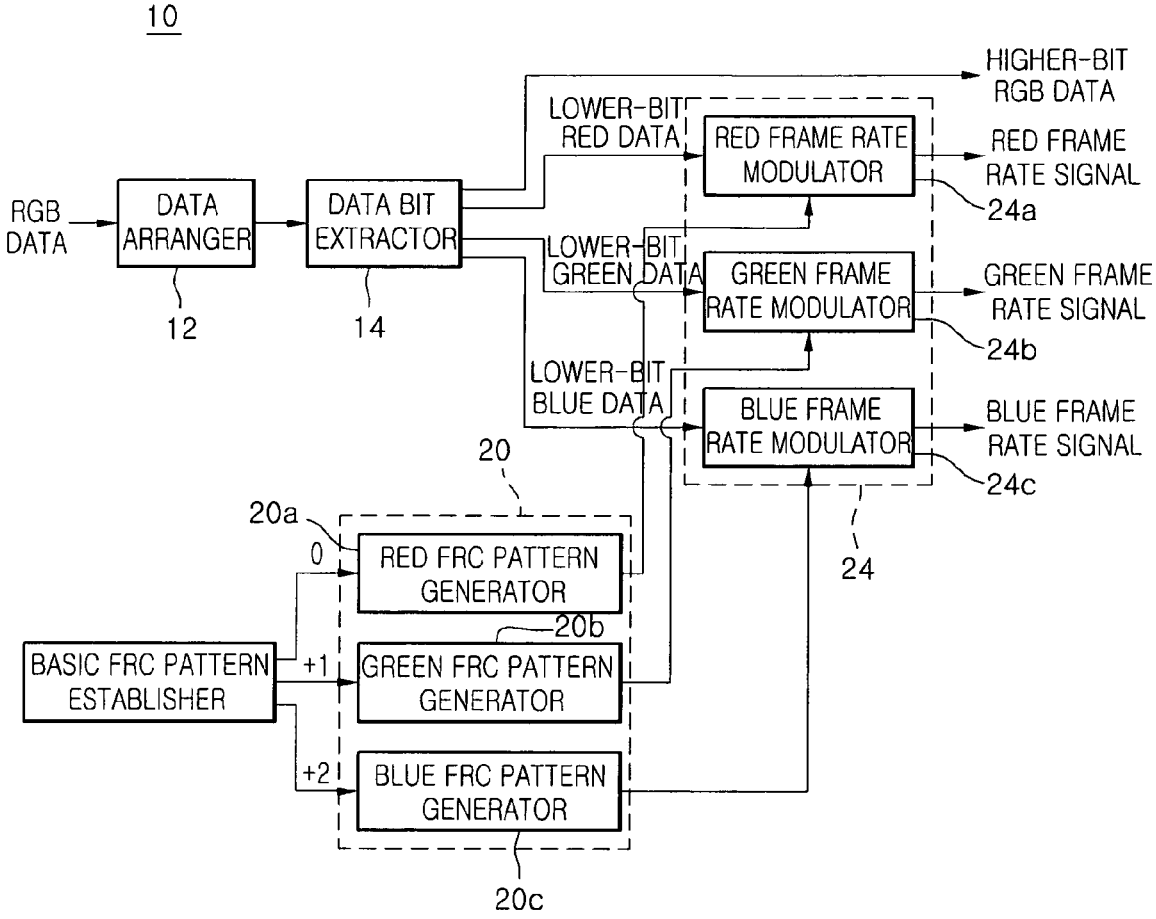
FIG. 2 is a block diagram showing an FRC unit according to an embodiment of the present disclosure.

FIG. 2 is a block diagram showing an FRC unit according to an embodiment of the present disclosure. An FRC unit 10 according to an embodiment of the present disclosure includes a data arranger 12, a data bit extractor 14, a basic FRC pattern establisher 18, an FRC pattern generator 20, and a frame rate modulator 24.

The basic FRC pattern establisher 18 is configured to include basic FRC patterns established to perform an FRC for each of 4 continuous frames. If the FRC is performed on the basis of lower 2-bit data separated from RGB data, the basic FRC patterns can be used for frame-rate-controlling in the unit of 4 sub-pixels during 4 frames in order to realize any one gray level of "00", "01", "10", and "11".

Figure 3:
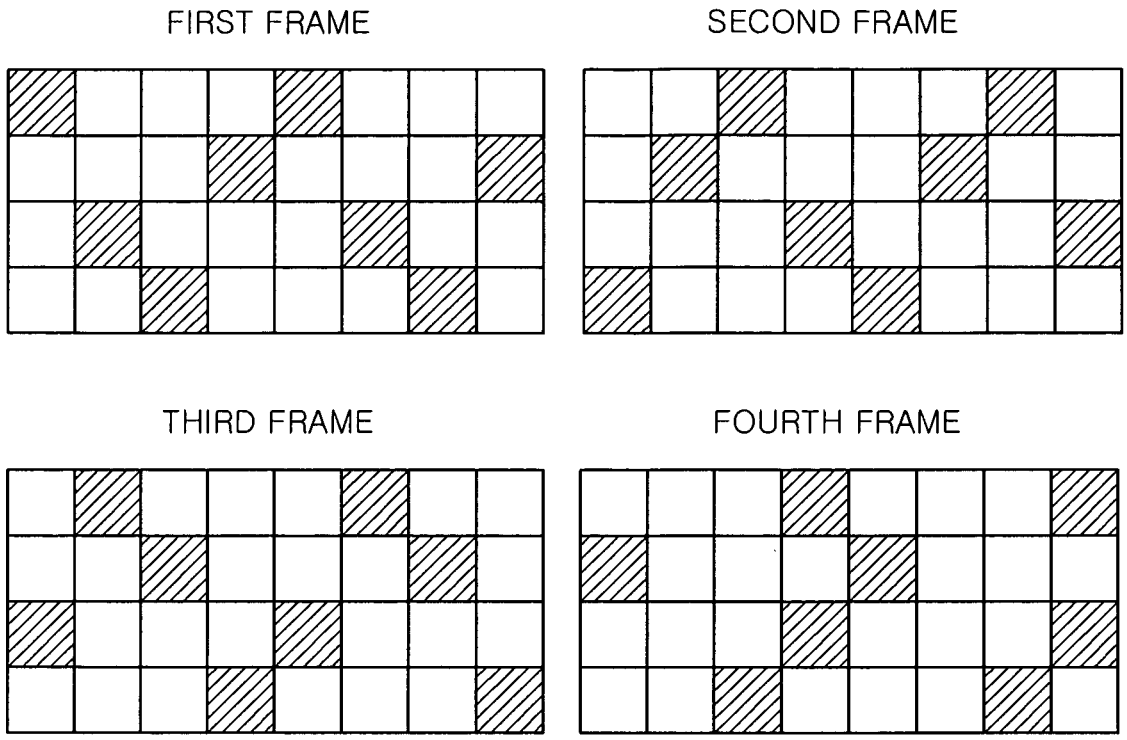
FIG. 3 is a data sheet showing a set of FRC patterns established for several continuous frames according to an embodiment of the present disclosure.

In case of 4 adjacent sub-pixels in a top and left portion of each frame shown in FIG. 3, an upper and left sub-pixel is turned-on and the remaining sub-pixels are turned-off during a first frame. During a second frame, a lower and right sub-pixel is turned-on and the remaining sub-pixels are turned-off. An upper and right sub-pixel is turned-on and the remaining sub-pixels are turned-off during a third frame. Also, a lower and left sub-pixel can be turned-on and the remaining sub-pixels can be turned-off during a fourth frame. In this way, the 4 sub-pixels are frame-rate-controlled during 4 frames, so that the gray level of "01" is displayed. The FRC patterns which 2 sub-pixels among 4 sub-pixels are turned-on and the rest of 4 sub-pixels are turned-off can be used for the FRC during 4 frames, in order to display the gray level of "10". In order to display the gray level of "11", the FRC patterns which 3 sub-pixels among 4 sub-pixels are turned-on and the rest of 4 sub-pixels are turned-off can be used for the FRC during 4 frames.

The rest of the sub-pixels shown in FIG. 3 are used for the FRC in the unit of 4 adjacent sub-pixels, as a unit pattern. Such a unit pattern in the FRC patterns can be modified according to the specifications of the FRC.

The FRC pattern generator 20 modifies the basic FRC patterns from the basic FRC pattern establisher 18 and generates new FRC patterns. To this end, the FRC pattern generator 20 can be configured to include a red FRC pattern generator 20*a*, a green FRC pattern generator 20*b*, and a blue FRC pattern generator 20*c*. The FRC pattern generator 20 will be operationally explained referring to FIGS. 4A to 4C.

Figure 4A:
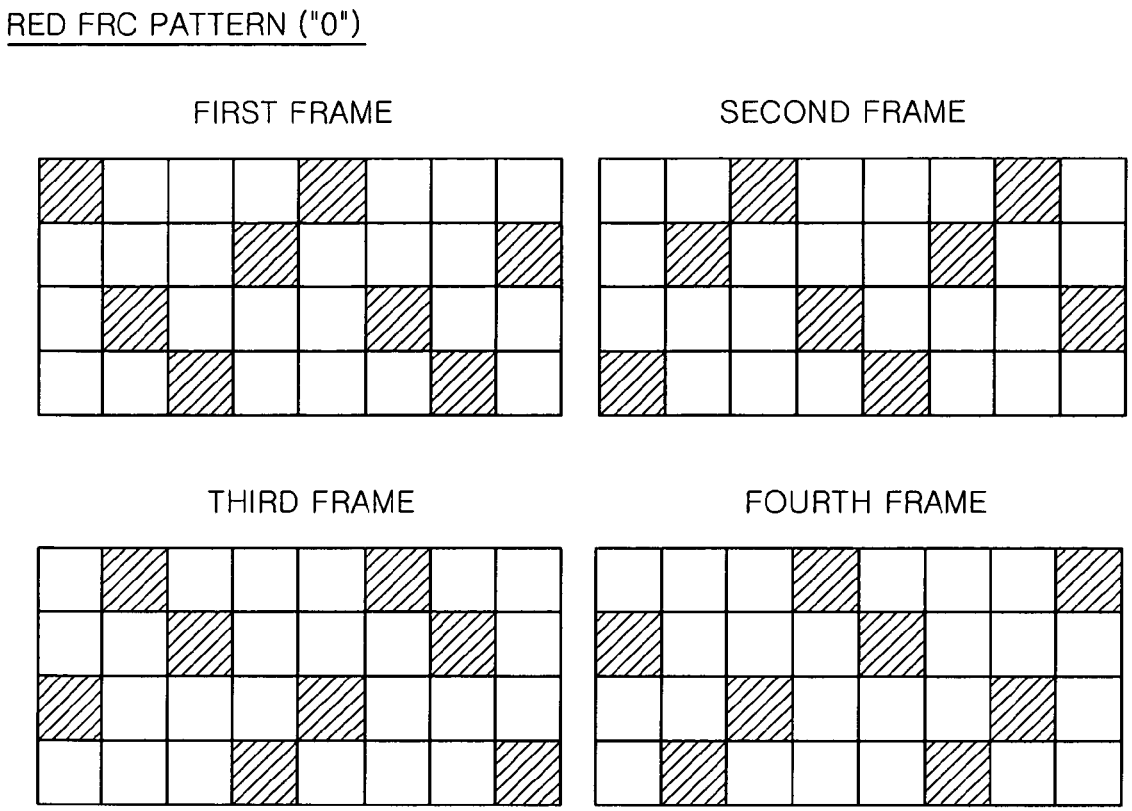
FIG. 4A to 4C are data sheets showing red, green, and blue FRC patterns derived from the basic FRC patterns of FIG. 3.

The red FRC pattern generator 20*a* originally uses the basic FRC patterns applied from the basic FRC pattern establisher 18 without modification and generates red FRC patterns used for performing the FRC on the basis of red lower-bit data extracted from R sub-pixel data. In other words, the red FRC patterns can be configured in the same way as the basic FRC patterns. Actually, the red FRC patterns are not shifted from the respective basic FRC patterns shown in FIG. 3. As such, the red FRC patterns can have the same configuration as the respective basic FRC patterns, as shown in FIG. 4A.

Figure 4B:
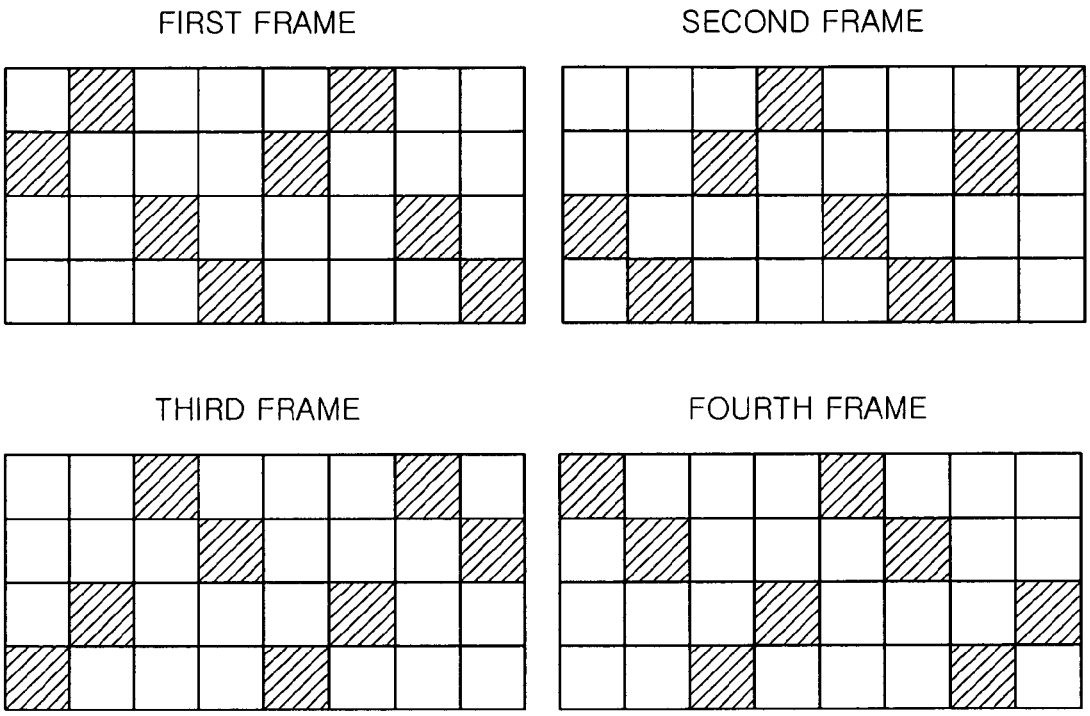

The green FRC pattern generator 20*b* shifts the basic FRC patterns applied from the basic FRC pattern establisher 18 by single sub-pixel in a horizontal direction, more specifically, in the right direction. Also, the green FRC pattern generator 20*b* uses the shifted FRC patterns and generates green FRC patterns used for performing the FRC on the basis of green lower-bit data extracted from green sub-pixel data. As shown in FIG. 4B, the green FRC patterns can be obtained through a process of shifting the respective basic FRC patterns shown in FIG. 3 by one sub-pixel in the right direction.

Figure 4C:
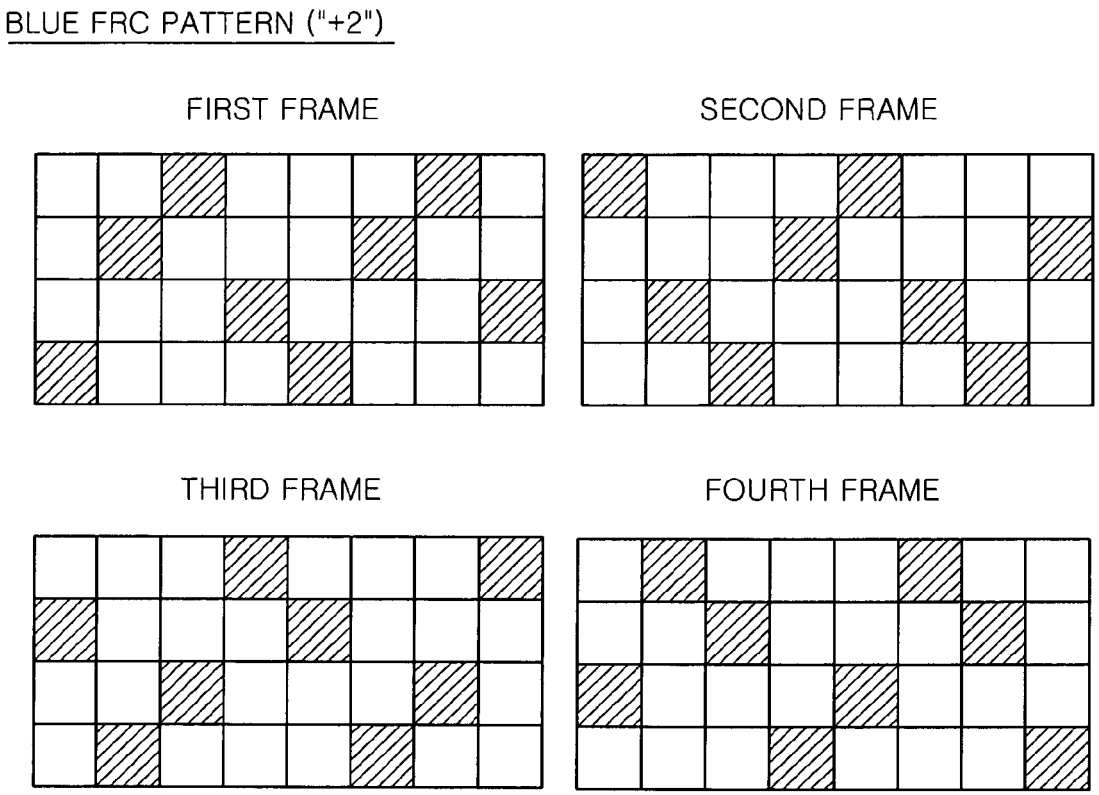

The blue FRC pattern generator 20*c* shifts the basic FRC patterns applied from the basic FRC pattern establisher 18 by two sub-pixels in the right direction. Also, the blue FRC pattern generator 20*c* uses the shifted FRC patterns and generates blue FRC patterns used for performing the FRC on the basis of blue lower-bit data extracted from blue sub-pixel data. As shown in FIG. 4C, the blue FRC patterns can be obtained through a process of shifting the respective basic FRC patterns shown in FIG. 3 by two sub-pixels in the right direction.

Although the green and blue FRC patterns are described to be obtained through the process of shifting the basic FRC pattern in the right direction, the present embodiment is not limited to this. In other words, the green and blue FRC patterns can be prepared by shifting the basic FRC patterns in a left direction, an upper direction, or a lower direction.

The data arranger 12 re-arranges RGB data input from an external video source (not shown) into groups of red sub-pixel data, green sub-pixel data, and blue sub-pixel data. More specifically, one frame of red sub-pixel data, one frame of green sub-pixel data, and one frame of blue sub-pixel data can be separated and arranged from one frame of RGB data. The red, green, and blue sub-pixel data in the frame unit are applied to the data bit extractor 14.

The data bit extractor 14 extracts a desired lower-bit data and a desired higher-bit data from each of the red, green, and blue sub-pixel data in the frame unit applied from the data arranger 12. For example, if the desired lower-bit data is established as 2 bits and the red sub-pixel data has a value of "01001001", a higher-bit red sub-pixel data becomes a value of "010010" and a lower-bit red sub-pixel data becomes a value of "01". The extraction of bit data can be performed for every red sub-pixel data within one frame, every green sub-pixel data within one frame, and every blue sub-pixel data within one frame.

Single sub-pixel data used for the FRC must be obtained from 4 continuous frames. Any one of four sub-pixel data applied to a same sub-pixel during four frames can be used for the FRC. A variety of methods can be used for selecting one among 4 sub-pixel data. For example, either sub-pixel data included in a first frame of four frames or average data obtained by finding an average of four sub-pixel data each included in the four continuous frames can be selected. The lower-bit red sub-pixel data, the lower-bit green sub-pixel data, and the lower-bit blue sub-pixel data by the data bit extractor 14 are applied to the frame rate modulator 24.

The frame rate modulator 24 uses the lower-bit sub-pixel data applied from the data bit extractor 14 and the FRC patterns applied from the FRC pattern generator 20, and generates frame rate signals to be used for performing the FRC during 4 frames. To this end, the frame rate modulator 24 can be configured to include a red frame rate modulator 24*a*, a green frame rate modulator 24*b*, and a blue frame rate modulator 24*c*.

The red frame rate modulator 24*a* uses the lower-bit red sub-pixel data applied from the data bit extractor 14 and the red FRC patterns applied from the red FRC pattern generator 20*a*, and generates a red frame rate signal to be used for performing the FRC during 4 frames. Similarly, the green frame rate modulator 24*b* uses the lower-bit green sub-pixel data applied from the data bit extractor 14 and the green FRC patterns applied from the green FRC pattern generator 20*b*, and generates a green frame rate signal to be used for performing the FRC during 4 frames. Also, The blue frame rate modulator 24*c* uses the lower-bit blue sub-pixel data applied from the data bit extractor 14 and the blue FRC patterns applied from the blue FRC pattern generator 20*c*, and generates a blue frame rate signal to be used for performing the FRC during 4 frames. The red, green, and blue frame rate signals can be output together with the higher-bit red, green, and blue sub-pixel data extracted by the data bit extractor 14.

In this manner, the red FRC patterns are directly generated from the basic FRC patterns, the green FRC patterns are obtained through a process of shifting the basic FRC patterns by one sub-pixel in the right direction, and the blue FRC patterns are prepared through the process of shifting the basic FRC patterns by two sub-pixels in the right direction. As such, each of the red, green, and blue sub-pixel data is not lopsided toward any one of positive and negative polarities. Therefore, the generation of picture defects, such as flickering, noise, dimness, and others is suppressed, and furthermore the deterioration of picture quality can be prevented. These effects will be more evidently revealed through the following description.

Figure 5:
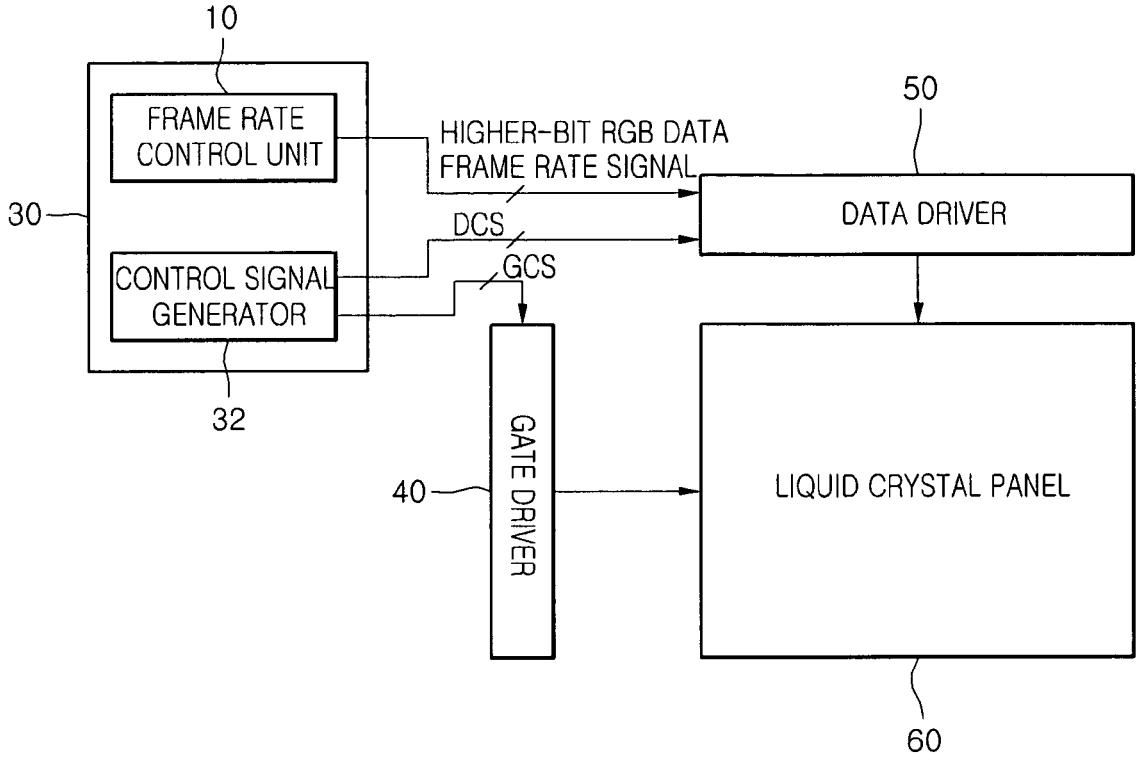
FIG. 5 is a block diagram showing an LCD device with an FRC unit according to an embodiment of the present disclosure.

FIG. 5 is a block diagram showing an LCD device with an FRC unit according to an embodiment of the present disclosure. An LCD device with an FRC unit according to an embodiment of the present disclosure includes a timing controller 30, a gate driver 40, a data driver 50, and a liquid crystal panel 60.

The liquid crystal panel 60 is configured to include a lower substrate, an upper substrate, and a liquid crystal layer interposed between the two substrates.

A plurality of gate lines and a plurality of data lines are arranged to cross each other on the lower substrate. A plurality of thin film transistors are connected to the respective gate and data lines. The plurality of thin film transistors are also connected to a plurality of pixel electrodes, respectively. The crossing of the gate and data lines can define a plurality of sub-pixels. The sub-pixels can include red sub-pixels, green sub-pixels, and blue sub-pixels. One red sub-pixel, one green sub-pixel, and one blue sub-pixel can configure a unit pixel (i.e., a single color pixel). Consequently, the lower substrate is configured to include a display area on which a plurality of unit pixels arranged in a matrix. The red, green, and blue sub-pixels can be arranged adjacently to one another. The red sub-pixels are arranged adjacently to one another in a vertical direction. Similarly, the green sub-pixels are arranged adjacently to one another in the vertical direction. Also, the blue sub-pixels are arranged adjacently to one another in the vertical direction. This pixel arrangement is referred to a stripe type.

The upper substrate can be configured to include color filters arranged opposite to the respective sub-pixels, and a black matrix disposed between the color filters. The color filters can include red color filters, green color filters, and blue color filters. The red color filters can be opposite to the respective red sub-pixels. Similarly, the green color filters can be opposite to the respective green sub-pixels. Also, the blue color filters can be opposite to the respective blue sub-pixels. The black matrix blocks light between the color filters. Also, the black matrix is disposed opposite to the gate and data lines arranged on the lower substrate.

The upper substrate can include a common electrode disposed on the color filters and the black matrix. The common electrode enables the liquid crystal layer to be driven by a vertical electric field. The liquid crystal panel 60 with this common electrode is referred to a twisted nematic mode panel. Alternatively, the common electrode is formed to alternate with the pixel electrode on the lower substrate. The common electrode alternating with the pixel electrode forces the liquid crystal layer to be driven by a horizontal electric field. In this case, the liquid crystal panel 60 is referred to an in-plane-switching mode panel. The LCD device of the present embodiment can be applied regardless of the twisted nematic and in-plane-switching modes. The electric field is generated by a data voltage applied to the pixel electrode and a common voltage applied to the common electrode. The electric field forces liquid crystal molecules of the liquid crystal layer to be displaced, so that a transmitting amount of light is controlled. As such, an image can be displayed on the liquid crystal panel 60.

The timing controller 30 generates gate control signals GCS and data control signals DCS using synchronous signals applied from an external video source. Also, the timing controller 30 extracts higher-bit red, green, and blue data and lower-bit red, green, and blue (RGB) data from RGB (red, green, and blue) data, which are applied from the external video source, and generates FRC signals on the basis of the lower-bit red, green, and blue data. The synchronous signals include a dot clock DCLK, a vertical synchronous signal Vsync, a horizontal synchronous signal Hsync, and a data enable signal DE. The gate control signals GCS are used to for controlling the gate driver 40. Such gate control signals GCS include a gate shift pulse, a gate clock signal, and a gate output enable signal. The data control signal DCS are used for controlling the data driver 50. Such data control signal DCS include a source shift pulse, a source clock signal, a source output enable signal, and a horizontal 2-dot inversion control signal 2-POL.

To this end, the timing controller 30 is configured to include a control signal generator 32 and an FRC unit 10. The control signal generator 32 derives the gate control signals GCS and the data control signals DCS from the synchronous DCLK, Vsync, Hsync, and DE. Also, the control signal generator 32 applies the gate control signals GCS and the data control signals DCS to the gate driver 40 and the data driver 50, respectively. The FRC unit 10 is already explained through the description of FIG. 2. As such, the detailed explanation of the FRC unit will be omitted.

The gate driver 40 responds to the gate control signals GCS applied from the control signal generator 32 and sequentially applies a gate signal to the plurality of gate lines on the liquid crystal panel 60. The gate signal can enable the plurality of transistors connected to the gate lines to be turned-on (or activated) in a single line.

The data driver 50 receives the higher-bit RGB data together with RGB FRC signal from the FRC unit 10. The data driver 50 further receives a horizontal 2-dot inversion control signal 2-POL and the data control signals DCS from the control signal generator 32. Also, the data driver 50 responds to the data control signals DCS, reflects the RGB FRC signal into the higher-bit RGB data, and converts the reflected higher-bit RGB data into analog RGB data voltages using a set of gamma voltages. The converted analog RGB data voltages are applied to the liquid crystal panel 60.

More specifically, the higher-bit red data is converted into an analog red data voltage. The analog red data voltage drives the respective red sub-pixel on the liquid crystal panel 60 during 4 frames, so that a red gray level corresponding to red data which consists of the higher-bit red data and the lower-bit red data is realized. Similarly, the higher-bit green data is converted into an analog green data voltage. The analog green data voltage drives the respective green sub-pixel on the liquid crystal panel 60 during 4 frames, so that a green gray level corresponding to green data which consists of the higher-bit green data and the lower-bit green data is realized. The higher-bit blue data is also converted into an analog blue data voltage. The analog blue data voltage drives the respective blue sub-pixel on the liquid crystal panel 60 during 4 frames, so that a blue gray level corresponding to blue data which consists of the higher-bit blue data and the lower-bit blue data is realized.

Moreover, the data driver 50 polarity-inverts the analog RGB data voltages according to the horizontal 2-dot inversion control signal which included in the data control signal DCS. In accordance therewith, the analog RGB data voltages which are frame-rate-controlled by the data driver 50 can be applied to the respective sub-pixels on the liquid crystal panel 60, as shown in FIGS. 6A to 6C.

In other words, the analog red data voltages applied to the respective red sub-pixels on the liquid crystal panel 60 are horizontal-(2-dot)-inverted and frame-rate-controlled during 4 frames, as shown in FIG. 6A. As such, among the analog red data voltages applied to the red sub-pixels which are marked by diagonal lines in each frame, the number of positive polarity red data voltages is equal to that of negative polarity red data voltages, as 4.

Similarly, the analog green data voltages applied to the respective green sub-pixels on the liquid crystal panel 60 are horizontal-(2-dot)-inverted and frame-rate-controlled during 4 frames, as shown in FIG. 6B. As such, among the analog green data voltages applied to the green sub-pixels which are marked by diagonal lines in each frame, the number of positive polarity green data voltages is equal to that of negative polarity green data voltages, as 4.

Furthermore, the analog blue data voltages applied to the respective blue sub-pixels on the liquid crystal panel 60 are horizontal-(2-dot)-inverted and frame-rate-controlled during 4 frames, as shown in FIG. 6C. As such, among the analog blue data voltages applied to the blue sub-pixels which are marked by diagonal lines in each frame, the number of positive polarity blue data voltages is equal to that of negative polarity blue data voltages, as 4.

In this way, each of the analog RGB data voltages applied to the RGB sub-pixels, which are marked by diagonal lines in FIGS. 6A to 6C, includes the positive and negative polarity blue data voltages the same number as each other. Therefore, the generation of picture defects such as flickering, noise, dimness, and others due to the related art green sub-pixel data which is lopsided toward any one of positive and negative polarities can be suppressed. Moreover, the deterioration of picture quality can be prevented.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

What is claimed is:

1. A frame rate control unit comprising:

a basic frame rate control pattern establisher configured to include basic red, green, and blue frame rate control patterns established to perform a frame rate control for a plurality of continuous frames;

a frame rate control pattern generator configured to modify the basic red, green, and blue frame rate control patterns to generate new red, green, and blue frame rate control patterns from the basic red, green, and blue frame rate control patterns which are established for the plurality of continuous frames;

a data bit extractor configured to extract higher-bit red, green, and blue data and lower-bit red, green, and blue data from each of input red, green, and blue data; and a frame rate modulator configured to generate red, green, and blue frame rate control signals to drive corresponding red, green, and blue sub-pixels by frame-rate-modulating the new red, green, and blue frame rate control patterns on the basis of the respective lower-bit red, green, and blue data and the new red, green, and blue frame rate control patterns, wherein the new green and blue frame rate control patterns are obtained through a process of shifting the basic green and blue frame rate control patterns to different sub-pixels in a shift direction and driving the green sub-pixels and the blue sub-pixels such that each frame has a same number of positive and negative voltage polarities.

2. The frame rate control unit of claim 1, wherein the red new frame rate control patterns correspond to the basic frame rate control patterns, respectively.

3. The frame rate control unit of claim 1, wherein the shift direction corresponds to any one of left, right, upper, and lower directions.

4. The frame rate control unit of claim 1, wherein the new green frame rate control patterns are obtained by shifting the basic frame rate control patterns by one sub-pixel.

5. The frame rate control unit of claim 1, wherein the new blue frame rate control patterns are obtained by shifting the basic frame rate control patterns by two sub-pixels.

6. The frame rate control unit of claim 1, wherein the red, green, and blue frame rate signals generated by the frame rate modulator are output together with the higher-bit red, green, and blue data extracted by the data bit extractor.

7. The frame rate control unit of claim 1, wherein the new red frame rate control patterns are directly generated from the basic frame rate control patterns, the new green frame rate control patterns are obtained through a process of shifting the basic frame rate control patterns by one sub-pixel in the right direction, and the new blue frame rate control patterns are prepared through the process of shifting the basic frame rate control patterns by two sub-pixels in the right direction.

8. A frame rate control method comprising:

establishing basic red, green, and blue frame rate control patterns for a plurality of continuous frames in a basic frame rate control pattern establisher;

deriving new red, green, and blue frame rate control patterns from the basic red green, and blue frame rate control patterns which are established for the plurality of continuous frames;

extracting higher-bit red, green, and blue data and lower-bit red, green, and blue data from each of input red, green, and blue data; and generating red, green, and blue frame rate control signals to drive corresponding red, green, and blue sub-pixels by frame-rate-modulating the new red, green, and blue frame rate control patterns on the basis of the respective lower-bit red, green, and blue data and the new red, green, and blue frame rate control patterns, wherein the new green and blue frame rate control patterns are obtained through a process of shifting the basic green and blue frame rate control patterns to different sub-pixels in a shift direction and driving the green sub-pixels and the blue sub-pixels such that each frame has a same number of positive and negative voltage polarities.

9. The frame rate control method of claim 8, wherein the new red frame rate control patterns correspond to the basic frame rate control patterns, respectively.

10. The frame rate control method of claim 9, wherein the shift direction corresponds to any one of left, right, upper, and lower directions.

11. The frame rate control method of claim 9, wherein the new green frame rate control patterns are obtained by shifting the basic frame rate control patterns by one sub-pixel.

12. The frame rate control method of claim 9, wherein the new blue frame rate control patterns are obtained by shifting the basic frame rate control patterns by two sub-pixels.

13. The frame rate control method of claim 8, wherein the red, green, and blue frame rate signals generated by the frame rate modulator are output together with the higher-bit red, green, and blue data extracted by the data bit extractor.

14. The frame rate control method of claim 8, wherein the new red frame rate control patterns are directly generated from the basic frame rate control patterns, the new green frame rate control patterns are obtained through a process of shifting the basic frame rate control patterns by one sub-pixel in the right direction, and the new blue frame rate control patterns are prepared through the process of shifting the basic frame rate control patterns by two sub-pixels in the right direction.

15. A liquid crystal display device comprising:

a liquid crystal panel on which pixels include red, green, and blue sub-pixels arranged in a matrix;

a basic frame rate control pattern establisher configured to include basic red, green, and blue frame rate control patterns established to perform a frame rate control for a plurality of continuous frames;

a timing controller configured to generate gate and data control signals and a horizontal 2-dot control signal used for inverting a driving voltage of the red, green, and blue sub-pixels in a horizontal 2-dot inversion system, and providing red, green, and blue frame rate control signals by generating new red, green, and blue frame rate control patterns from the basic red, green, and blue frame rate control patterns which are established for the plurality of continuous frames, extracting higher-bit red, green, and blue data and lower-bit red, green, and blue data from each of input red, green, and blue data, and frame-rate-modulating the new red, green, and blue frame rate control patterns on the basis of the respective lower-bit red, green, and blue data;

a gate driver configured to respond to the gate control signal and drive the liquid crystal panel; and a data driver configured to convert the higher-bit red, green, and blue data into analog red, green, and blue data voltages and drive the liquid crystal panel using the converted red, green, and blue data voltage according to the red, green, and blue frame rate control signals during the plurality of frames, wherein the new green and blue frame rate control patterns are obtained through a process of shifting the basic green and blue frame rate control patterns to different sub-pixels in a shift direction and driving the green sub-pixels and the blue sub-pixels such that each frame has a same number of positive and negative voltage polarities.

16. A liquid crystal display device of claim 15, wherein the red, green, and blue frame rate signals generated by the frame rate modulator are output together with the higher-bit red, green, and blue data extracted by the data bit extractor.

17. A liquid crystal display device of claim 15, wherein the new red frame rate control patterns are directly generated from the basic frame rate control patterns, the new green frame rate control patterns are obtained through a process of shifting the basic frame rate control patterns by one sub-pixel in the right direction, and the new blue frame rate control patterns are prepared through the process of shifting the basic frame rate control patterns by two sub-pixels in the right direction.

* * * * *